US007015746B1

(12) United States Patent
Martinez et al.

(10) Patent No.: US 7,015,746 B1
(45) Date of Patent: Mar. 21, 2006

(54) BOOTSTRAPPED BIAS MIXER WITH SOFT START POR

(75) Inventors: Steve A. Martinez, Tucson, AZ (US); Paul D. Ranucci, Tucson, AZ (US); David J. Megaw, Tucson, AZ (US)

(73) Assignee: National Semiconductor Corporation, Santa Clara, CA (US)

( * ) Notice: Subject to any disclaimer, the term of this patent is extended or adjusted under 35 U.S.C. 154(b) by 36 days.

(21) Appl. No.: 10/842,034

(22) Filed: May 6, 2004

(51) Int. Cl.
*G05F 1/10* (2006.01)

(52) U.S. Cl. ..... 327/543; 327/143; 327/408

(58) Field of Classification Search ..... 323/312, 323/313, 314, 315, 316; 327/143, 390, 407, 327/408, 534, 535, 536, 537, 538, 540, 541, 327/543
See application file for complete search history.

(56) References Cited

U.S. PATENT DOCUMENTS 5,087,830 A * 2/1992 Cave et al. ..... 327/539
5,155,384 A 10/1992 Ruetz
5,243,231 A 9/1993 Baik
5,543,745 A * 8/1996 Notani ..... 327/538
5,796,281 A * 8/1998 Saeki et al. ..... 327/206
5,801,584 A * 9/1998 Mori ..... 327/543
6,057,721 A * 5/2000 Nolan et al. ..... 327/143
6,107,868 A * 8/2000 Diniz et al. ..... 327/543
6,163,206 A * 12/2000 Kobayashi ..... 327/540
6,281,722 B1 8/2001 Sirito-Olivier et al.
6,304,131 B1 * 10/2001 Huggins et al. ..... 327/538
6,469,570 B1 * 10/2002 Inomata et al. ..... 327/536
6,525,598 B1 * 2/2003 Croman ..... 327/543
6,529,563 B1 * 3/2003 Mosinskis et al. ..... 375/317
6,664,847 B1 * 12/2003 Ye ..... 327/543
6,777,920 B1 * 8/2004 Furutani et al. ..... 323/280
6,778,008 B1 * 8/2004 Andrews ..... 327/543
6,856,189 B1 * 2/2005 Somerville ..... 327/539

* cited by examiner

*Primary Examiner*—Jeffrey Zweizig
(74) *Attorney, Agent, or Firm*—Darby & Darby PC; John W. Branch

(57) ABSTRACT

A biasing circuit is arranged to provide relatively well controlled startup and steady state behavior for a reference circuit such as noise immunity and reduced dependence on supplies. The biasing circuit initially employs an independent bias current for biasing the reference circuit at startup until a large enough bootstrapped (output voltage referenced) bias current can be generated that can take over the subsequent biasing of the circuit in the steady state. In one embodiment, a Power On Reset (POR) signal can be generated during the transition from an initial biasing of the reference circuit by the independent bias current to a subsequent steady state biasing provided by the bootstrapped bias current. Also, the assertion of the POR signal can be employed to turn off the transistors providing the independent bias current.

15 Claims, 10 Drawing Sheets

BOOTSTRAPPED BIAS MIXER WITH SOFT START POR

FIELD OF THE INVENTION

The invention is related to any system utilizing a sub-regulated supply or reference output, and in particular, to an apparatus for improving the robustness and control of the startup behavior for the sub-regulated or reference output.

BACKGROUND OF THE INVENTION

For precision voltage reference circuits, a bootstrapped bias generator that is supplied from a sub-regulated source is often employed to provide additional supply independence and noise immunity from the input supply. Typically, a bootstrapped bias generator is connected to a circuit that generates a substantially constant output signal (Vout) from a received signal (Vin). In this type of circuit, the bias is dependent on the output signal of the circuit which is powered by that same bias.

FIG. 1 illustrates a block diagram of an exemplary reference circuit with a bootstrapped bias generator connected in a feedback loop with the circuit. During power up, the bootstrapped bias generator follows the output of the circuit (Vout) as it transitions from zero volts to its steady state value. However, since the bootstrapped (output voltage referenced) bias current follows Vout, the bias current is time dependent. Also, the circuitry in the bias loop may have more than one stable operating point. Startup circuits are employed to force a condition in which the desired operating point is converged upon. Use of such circuits often results in undesirable large-signal behavior during the time the startup circuit is engaged. Additionally, mismatch within the circuit can be a function of the bias point and can have an effect on startup. The startup behavior can also be dependent on a variable external load.

For these reasons it can be difficult to achieve robust and well damped start up behavior under all conditions using a bootstrapped bias generator alone. A non-bootstrapped (referenced from the input supply) bias generator that does not share its feedback loop with the circuit it is biasing may be employed to avoid some of the limitations of a bootstrapped bias generator. However, although an independent (input supply referenced) bias generator can bias the circuit to a known state at startup, it is more dependent on the supply (VDD) than a bootstrapped bias and can couple significant input supply noise to the operation of the reference circuit. A non-bootstrapped bias can also show some dependence on the input supply since it is referenced to it. This can translate to degraded line regulation of the system.

BRIEF DESCRIPTION OF THE DRAWINGS

Non-limiting and non-exhaustive embodiments of the present invention are described with reference to the following drawings, in which.

DETAILED DESCRIPTION

Figure 1:
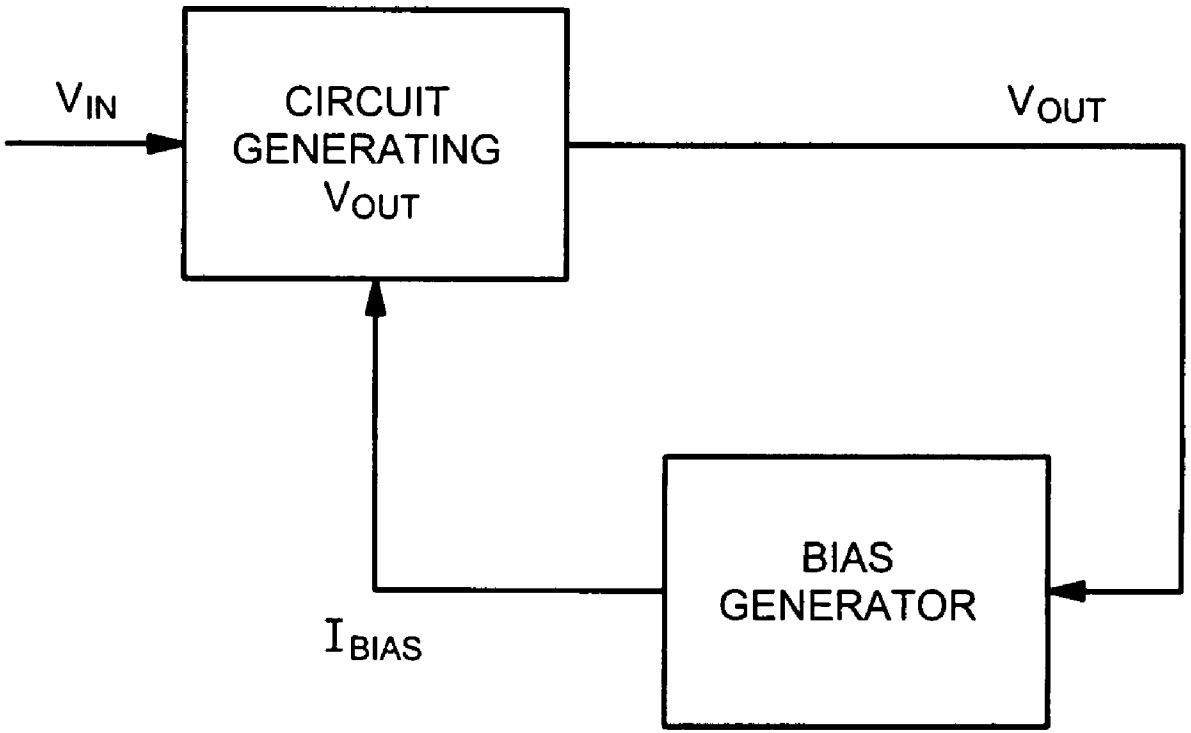
FIG. 1 shows a block diagram of an embodiment of a voltage reference circuit with a bootstrapped bias generator in a feedback loop.

Various embodiments of the present invention will be described in detail with reference to the drawings, where like reference numerals represent like parts and assemblies throughout the several views. Reference to various embodiments does not limit the scope of the invention, which is limited only by the scope of the claims attached hereto. Additionally, any examples set forth in this specification are not intended to be limiting and merely set forth some of the many possible embodiments for the claimed invention.

Briefly stated, a biasing circuit is arranged to provide relatively well controlled startup behavior for a reference circuit such as noise immunity and reduced dependence on independent supplies. The biasing circuit initially employs an independent (input supply referenced) bias current for biasing the reference circuit at startup until a large enough bootstrapped bias current can be generated that can take over the subsequent steady state biasing of the reference circuit. In one embodiment, a Power On Reset (POR) signal can be generated during the transition from an initial biasing of the reference circuit by the independent (input supply referenced) bias current to a subsequent steady state biasing provided by the bootstrapped bias current. Also, the assertion of the POR signal can be employed to turn off the transistors providing the independent bias current.

Figure 2:
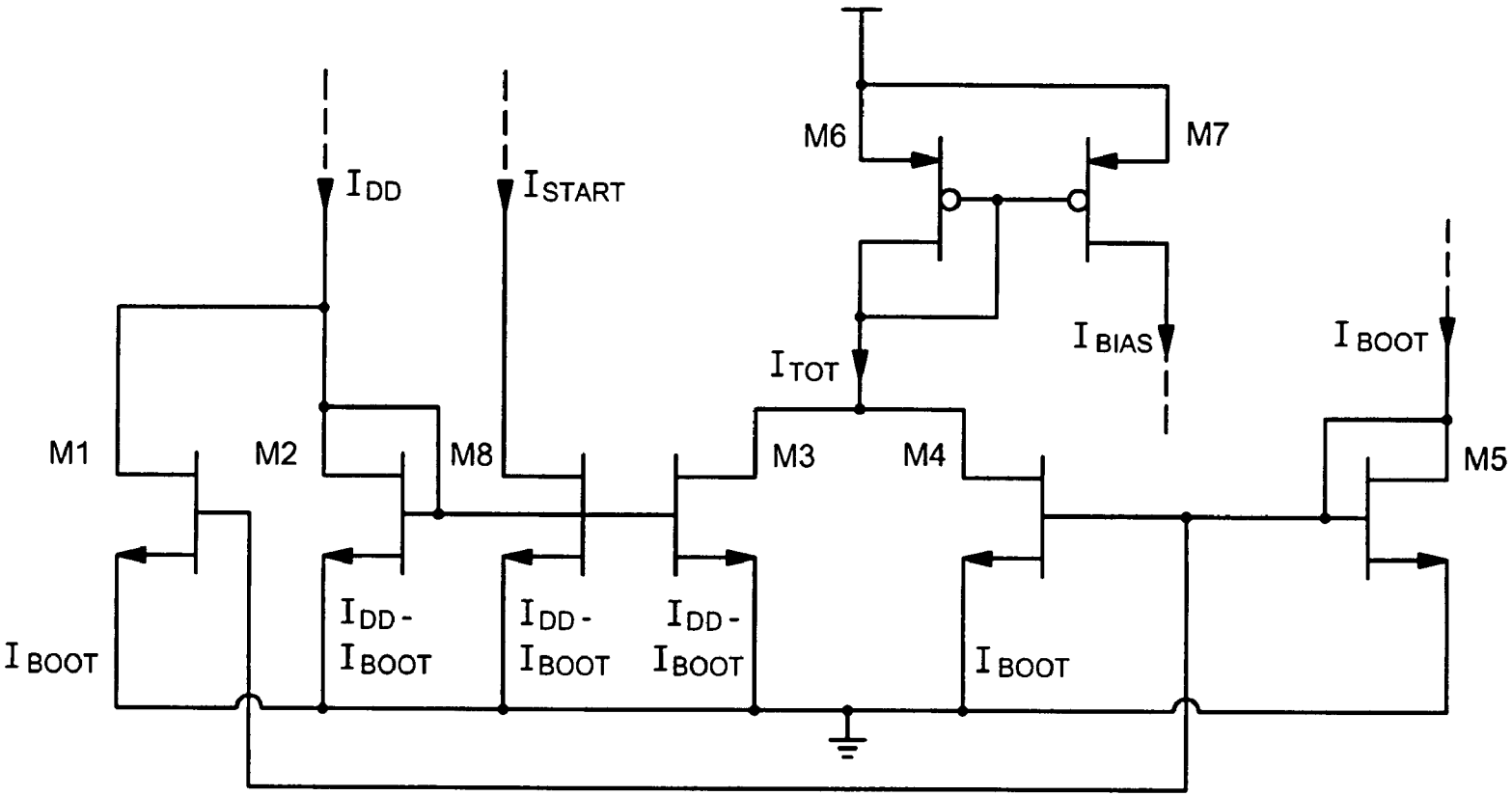
FIG. 2 illustrates a schematic diagram of a bias circuit that employs the mixing of an independent bias current and a bootstrapped bias current during startup.

FIG. 2 illustrates a schematic diagram of one embodiment where an independent (input supply referenced) bias current is initially employed for biasing a reference circuit until a bootstrapped bias current can take over biasing of the circuit during startup. The independent (input supply referenced) bias current and bootstrapped bias current are mixed over time to generate a relatively constant bias current (Ibias). As shown in the figure, the aspect ratios of MOSFET transistors M1–M5 and M6–M7 are substantially the same. Also, the scaling of these MOSFET transistors are typically dependent on a particular application. In other embodiments, the reference circuit may include transistors other than MOSFET transistors, such as BJTs, and the like.

As shown in FIG. 2, Iboot is mirrored in transistors M1 and M4. Also, the contribution of Idd minus the contribution of Iboot flows through transistor M2, which is subsequently mirrored by the current which flows through transistors M8 and M3. Additionally, the startup current (Istart) is generated by the contribution of Idd minus the contribution of Iboot and can be scaled to suit the application by sizing M8. As discussed in greater detail below, once the circuit transitions from startup to a steady state mode of operation, the value of Istart transitions to a substantially zero value.

In operation, the magnitude of the independent (input supply referenced) bias current (Idd) is arranged to be substantially similar to the final value of the bootstrapped bias current (Iboot). At startup, Ibias is maintained at a relatively constant value with respect to time and relatively equal in magnitude to Idd. During startup, the contribution produced by the bootstrapped bias generator (Iboot) to the bias current (Ibias) is relatively equivalent to zero and the contribution by the independent (input supply referenced) bias current (Idd) is relatively equivalent to the bias current (Ibias).

Additionally, as the output of the circuit powered by the bias current (Ibias) approaches a steady state, the contribution of the bootstrapped bias current (Iboot) to Ibias begins to dominate the contribution initially provided by Idd. Also, the increasing contribution to Ibias that is provided by Iboot simultaneously cancels out a substantially similar contribution provided by Idd. Thus, once the contribution of the bootstrapped bias current (Iboot) reaches its steady state operating value, the independent bias current (Idd) no longer provides a relatively significant contribution to the bias current (Ibias). Moreover, since the steady state contribution of Iboot is relatively equivalent to Ibias (Idd is relatively equivalent to zero), the output of the circuit is relatively independent of the supply that provides Idd.

Figure 3:
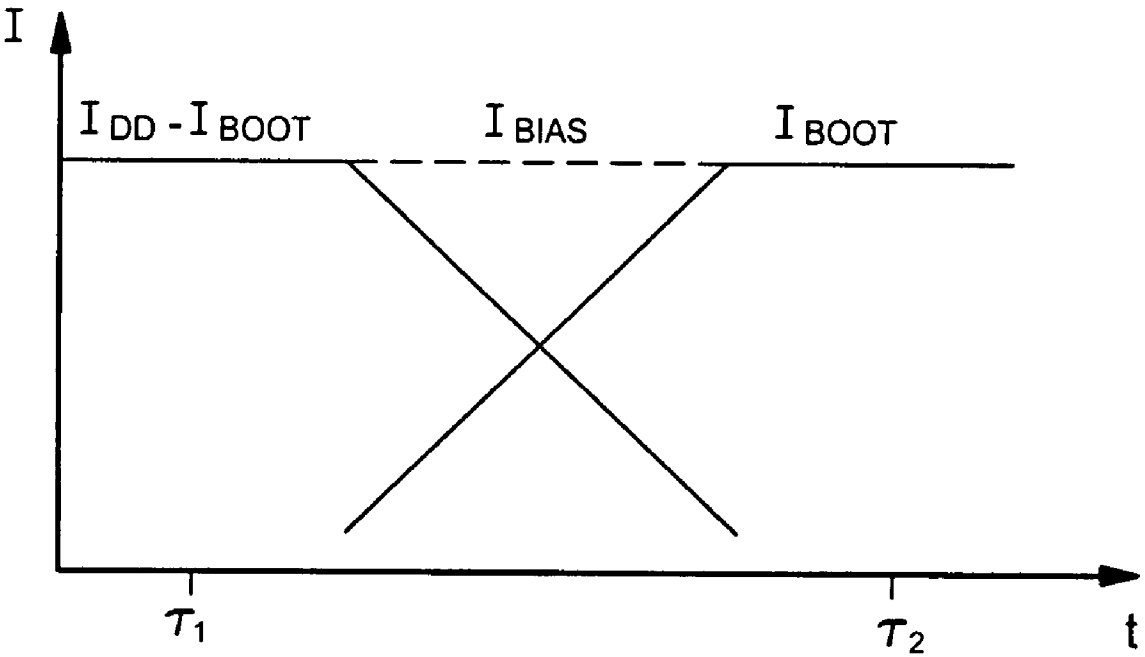
FIG. 3 shows a graph of waveforms of currents versus time where a transition point occurs at startup between an independent bias current and a bootstrapped bias current.

FIG. 3 illustrates a graph of the waveforms of current versus time during the startup of a circuit. As shown, the bias current (Ibias) is initially equivalent to the contribution of the independent bias current (Idd) minus the bootstrapped bias current (Iboot). However, after a period of time, Ibias becomes relatively equivalent to Iboot and the contribution of Idd minus Iboot becomes relatively equivalent to zero.

Figure 4:
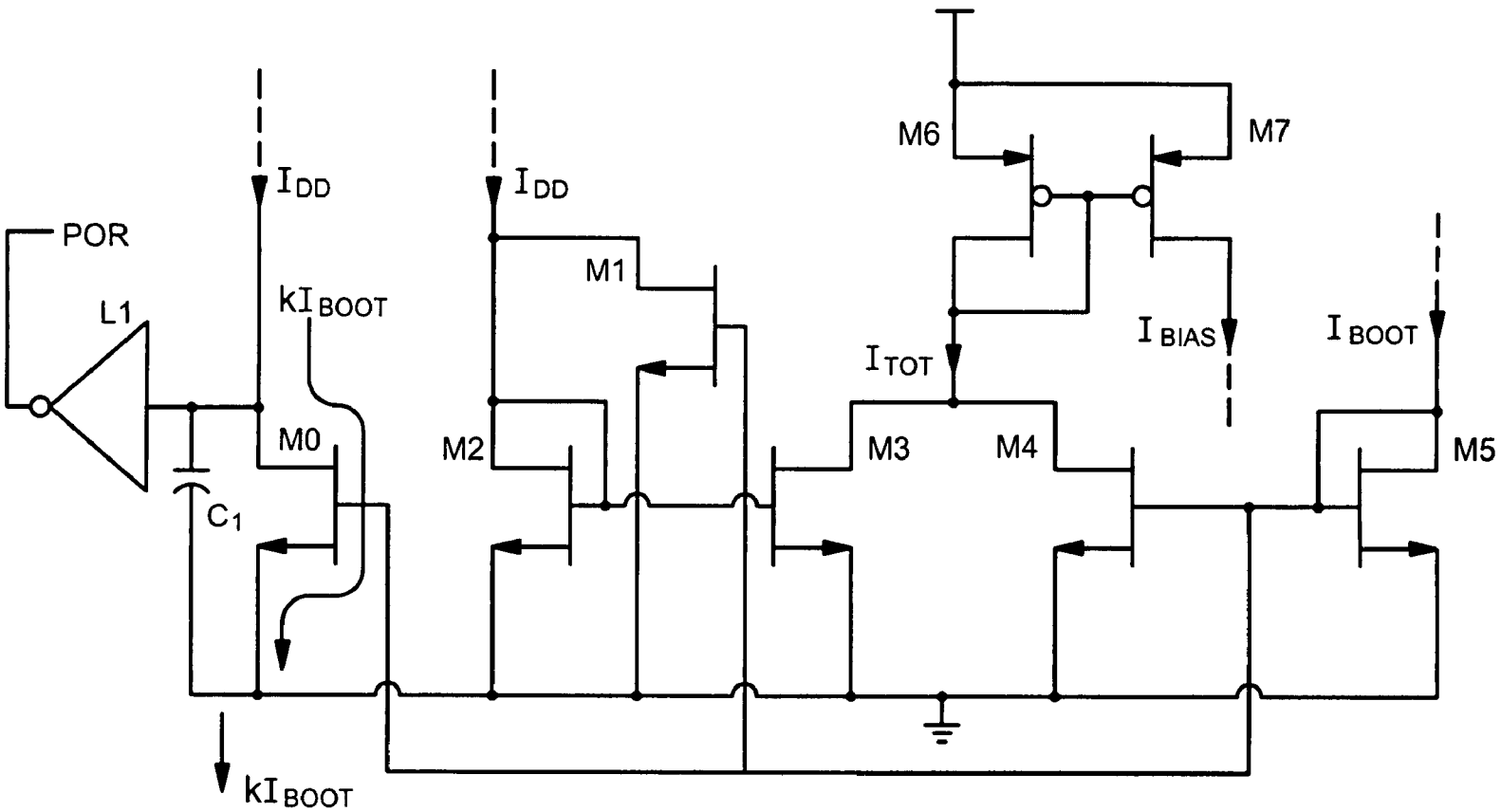
FIG. 4 illustrates a schematic diagram of a bias circuit that employs the mixing of an independent bias current and a bootstrapped bias current to provide a POR signal during startup.

FIG. 4 illustrates a schematic diagram of one embodiment of the invention that compares independent and scaled bootstrapped bias currents to generate a relatively accurate Power On Reset (POR) signal. The MOSFET transistors shown in FIG. 4 that are similarly named in FIG. 3 operate in substantially the same way as discussed above. Additionally, the embodiment shown in FIG. 4 includes MOSFET transistor M0 and inverter L1 for asserting a POR signal. However, for simplicity of the diagram, this embodiment does not include MOSFET transistor M8 as shown in FIG. 3.

In operation, the bootstrapped bias current (Iboot) flows through M5 and some portion of that current (kIboot) is mirrored at M0. The aspect ratio of M0 can be chosen such that the POR signal is asserted when Iboot is at some portion (1/k) of its final steady state value. To control when the POR signal can be asserted, this portion (1/k) can be correlated to a particular percentage of Iboot's steady state value. At startup, the independent bias current (Idd) charges up capacitor C1. After the initial startup, there is a transition to a relatively steady state where the value of kIboot has increased to a point where it can cause capacitor C1 to discharge. In response to the discharge of the capacitor C1, the inverter (L1) changes its state and asserts the POR signal.

In one embodiment, the assertion of the POR signal can be employed to ground the gates of M2 and M3 so that relatively no independent bias current (Idd) is contributed to Ibias during the steady state of operation.

Figure 5:
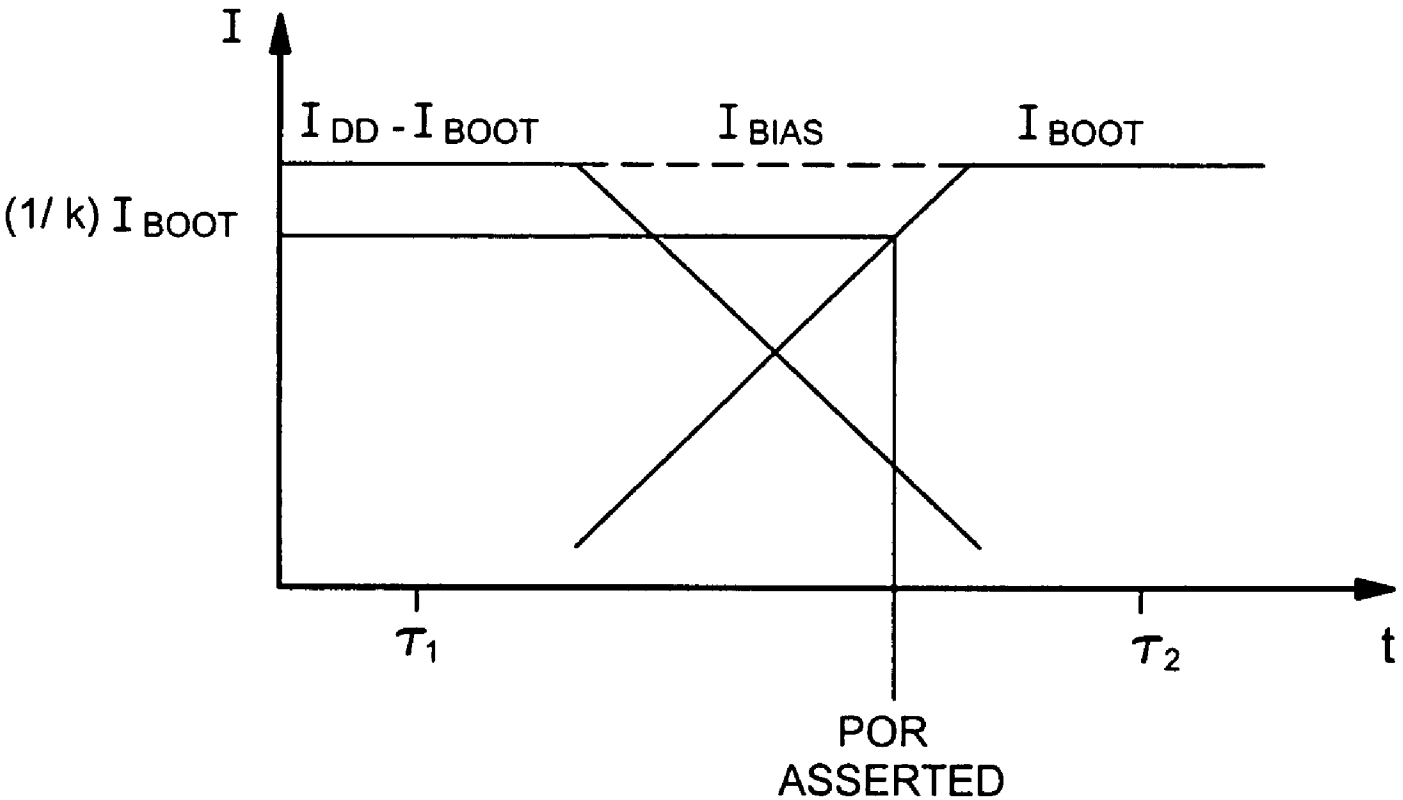
FIG. 5 shows a graph of waveforms of currents versus time where a transition point from an independent bias current to a bootstrapped bias current enables a POR signal to be generated.

FIG. 5 illustrates a graph of the waveforms of currents versus time during the startup of a circuit. As shown, the bias current (Ibias) is initially equivalent to the contribution of the independent bias current (Idd) minus the bootstrapped bias current (Iboot). However, after a period of time, Ibias becomes relatively equivalent to Iboot and the contribution of Idd minus Iboot becomes relatively equivalent to zero. Additionally, where the value of Iboot is relatively equivalent to some portion (1/k) of the steady state value of Iboot, the POR signal is shown asserted.

Figure 6:
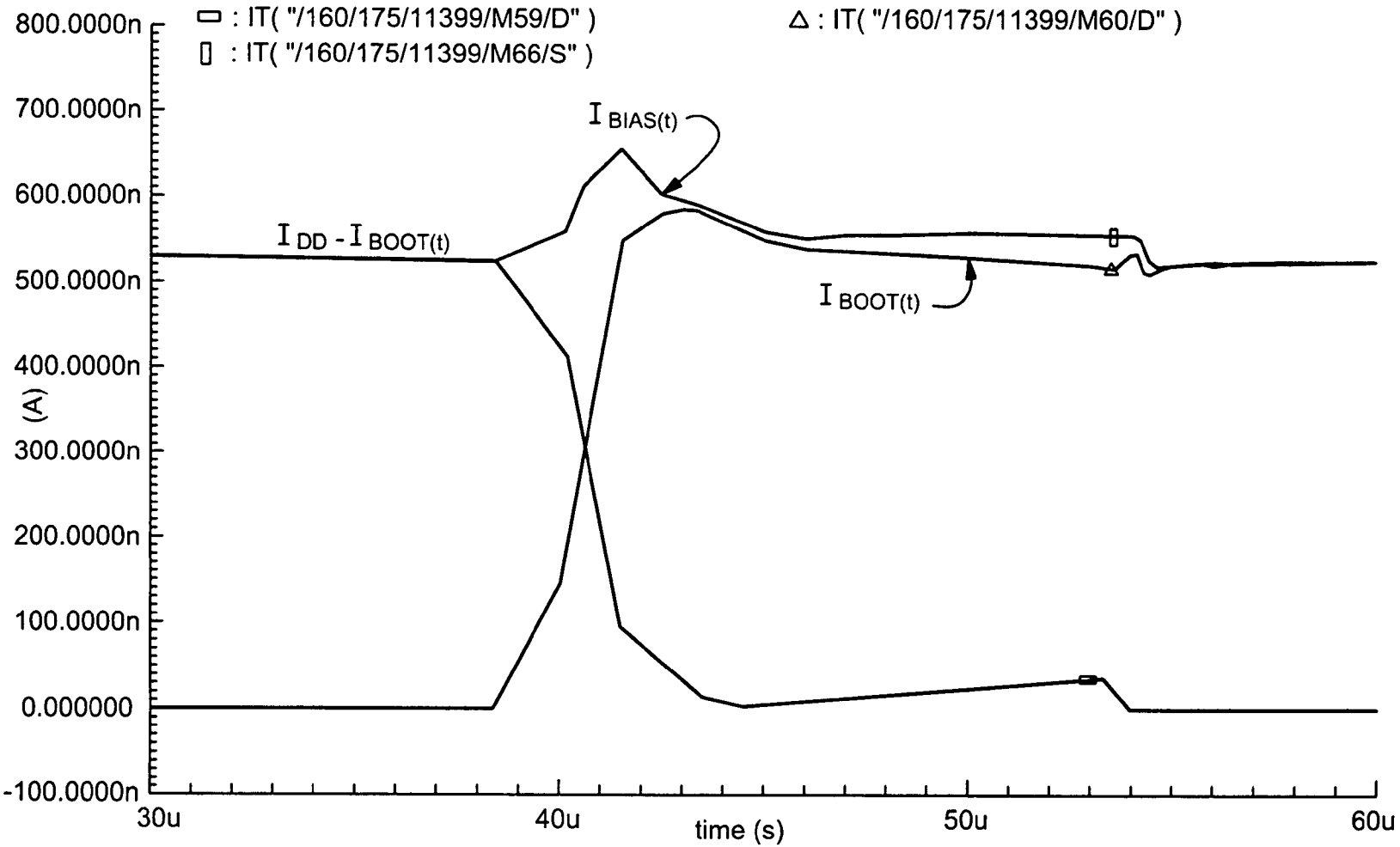
FIG. 6 illustrates a graph of waveforms of currents versus time where a transition point occurs at startup between an independent bias current and a bootstrapped bias current.

FIG. 6 illustrates another graph showing simulation plots of waveforms of currents versus time. As shown, the bias current (Ibias) provided by one embodiment of the invention is initially equivalent to the contribution of the independent bias current (Idd) minus the bootstrapped bias current (Iboot). However, after a period of time, Ibias becomes relatively equivalent to Iboot and the contribution of Idd minus Iboot becomes relatively equivalent to zero. Also, Ibias remains relatively stable as it transitions from startup to a steady state.

Figure 7A:
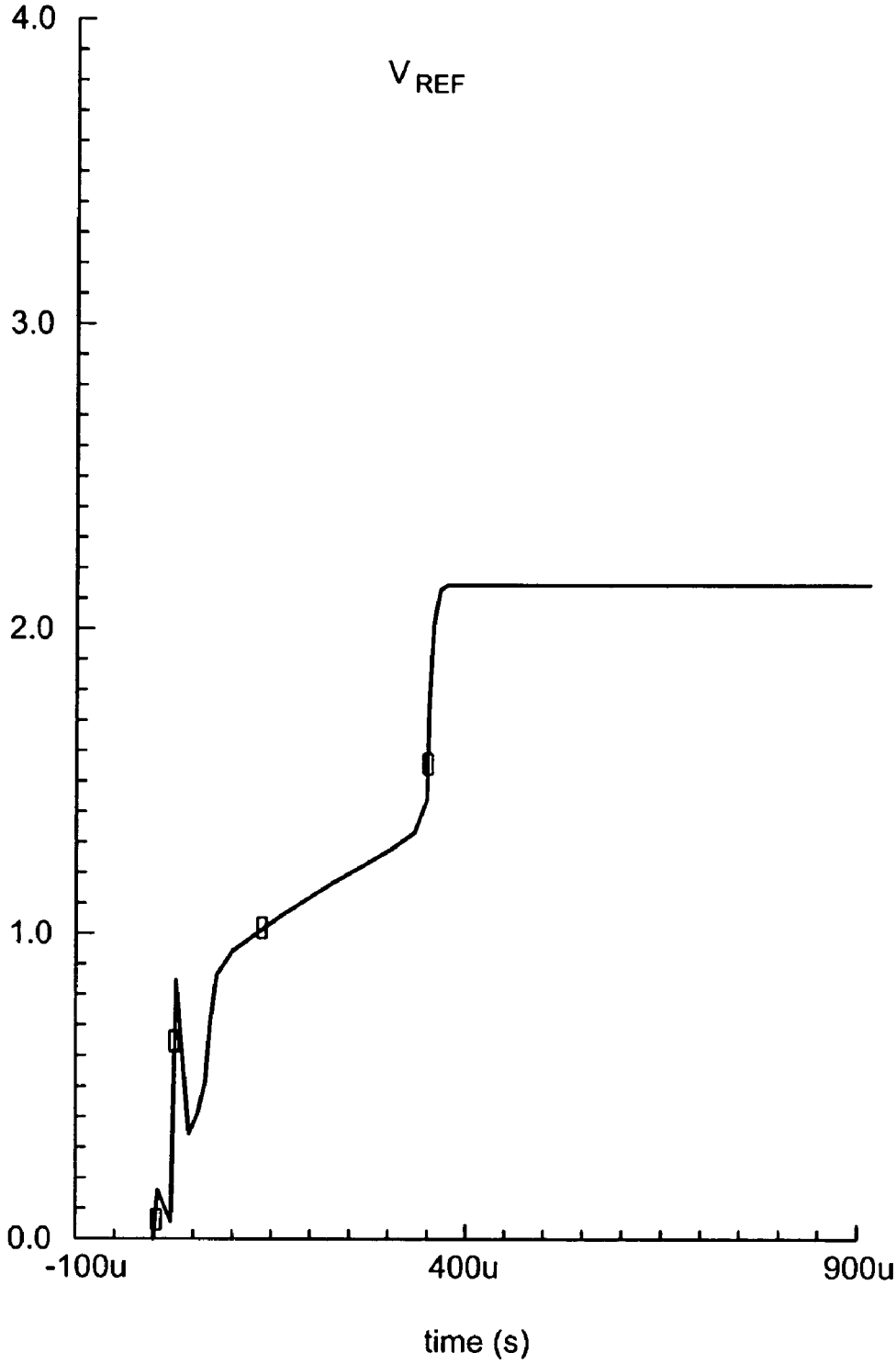
FIG. 7A shows a graph of a waveform for a voltage reference signal versus time at startup.

FIG. 7A illustrates another graph showing the plot of a waveform for a reference voltage (Vref) over time. The bias current for this reference voltage is provided by one embodiment of the invention. As shown, the reference voltage transitions from relatively zero to a steady state value with relatively no overshoot.

Figure 7B:
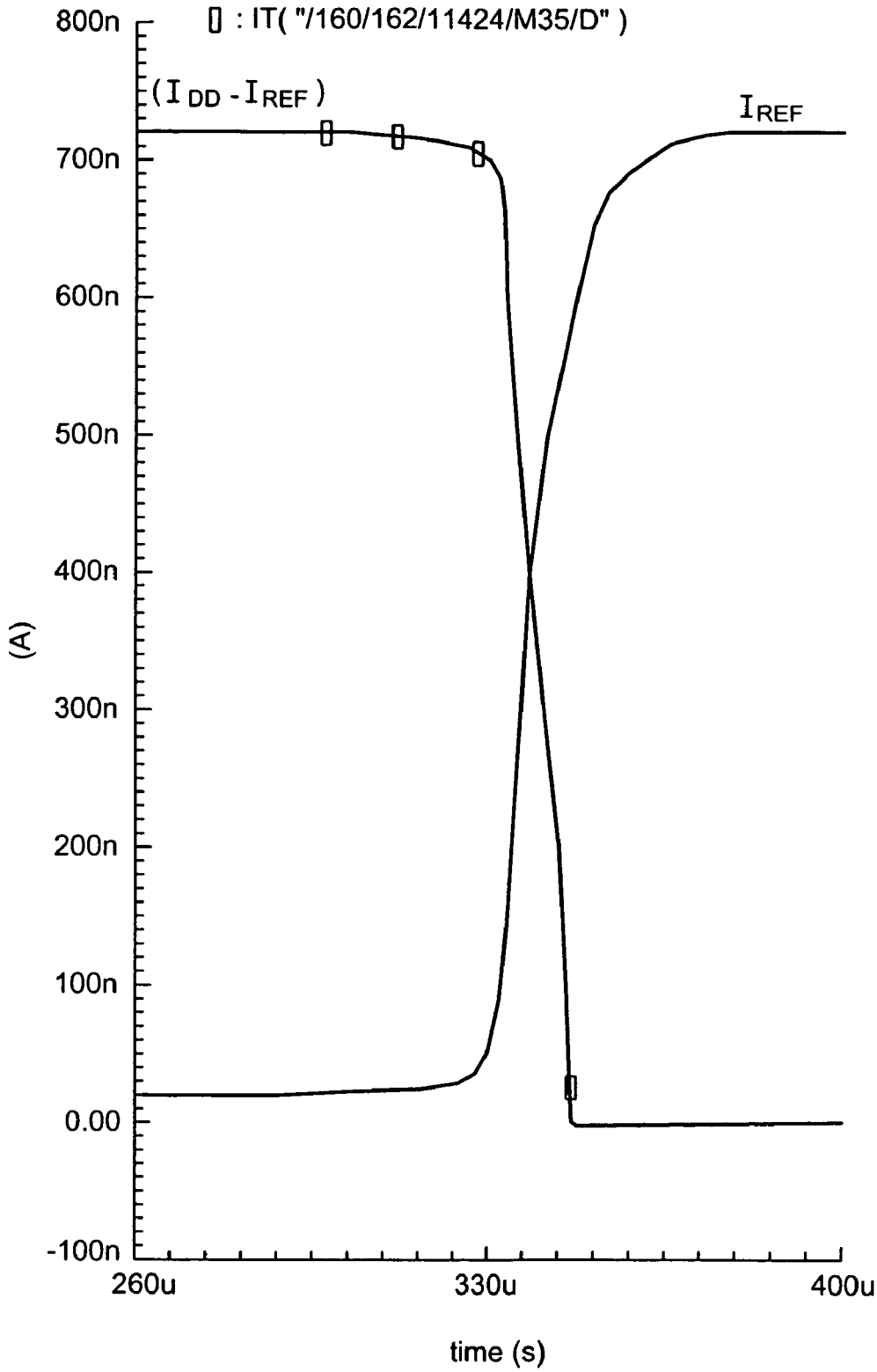
FIG. 7B illustrates a graph of waveforms of currents versus time for Idd–Iboot and Iref.

FIG. 7B illustrates another graph showing the plot of the waveforms for current over time. In this figure, the waveforms represent the independent bias current (Idd–Iref) and the reference current (Iref) for the reference circuit. In this embodiment, Iref is relatively equivalent to the signal called Iboot previously. As shown, the reference current transitions from relatively zero to a steady state value with relatively no overshoot.

Figure 7C:
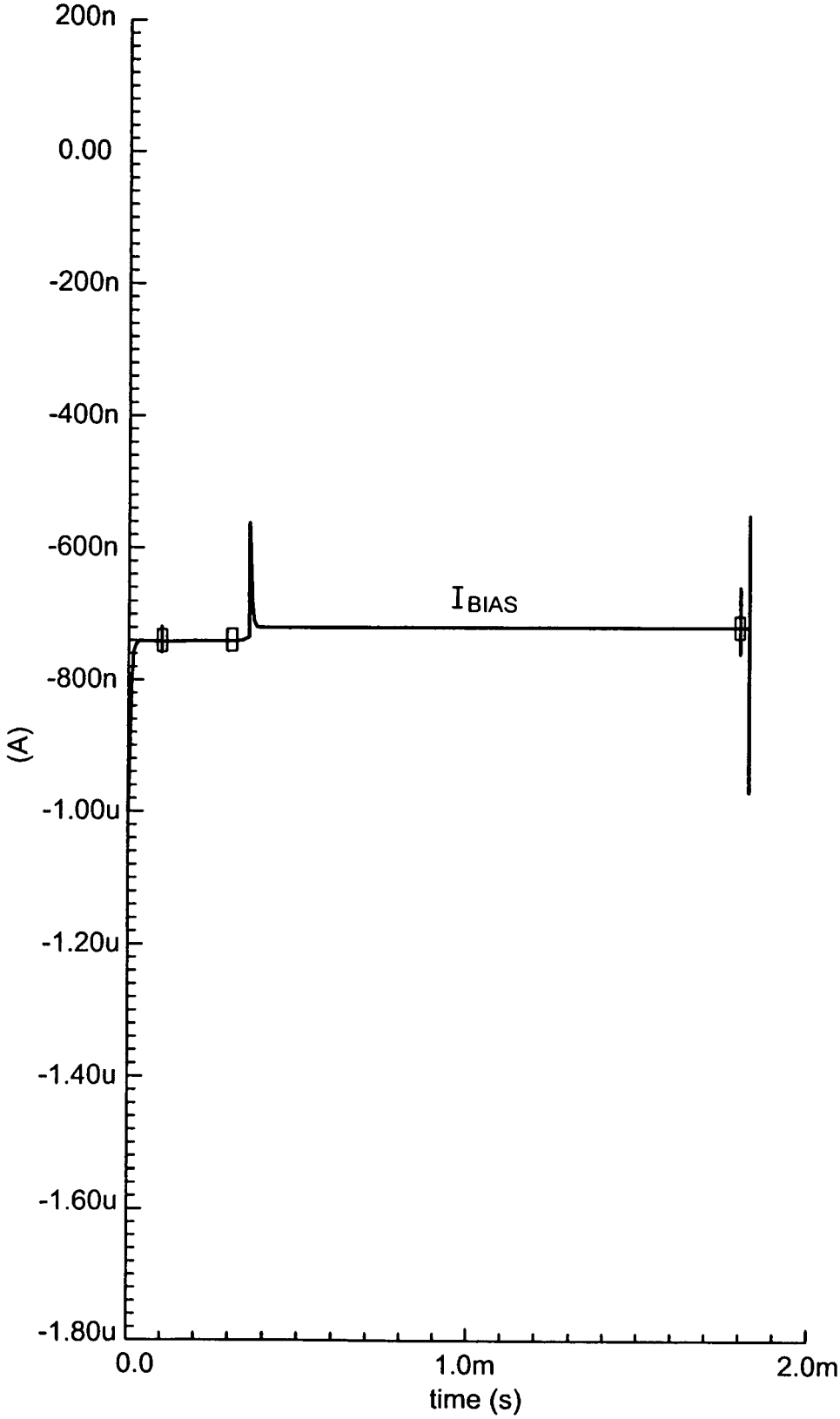
FIG. 7C shows a graph of a waveform for a bias current versus time, arranged in accordance with the invention.

FIG. 7C illustrates another graph showing the plot of a waveform for current over time. Although the waveforms for Idd–Iboot and Iboot are not shown, the combined contributions of these two currents is represented by the plot of Ibias. As shown, the bias current is relatively stable with relatively little noise.

Figure 8:
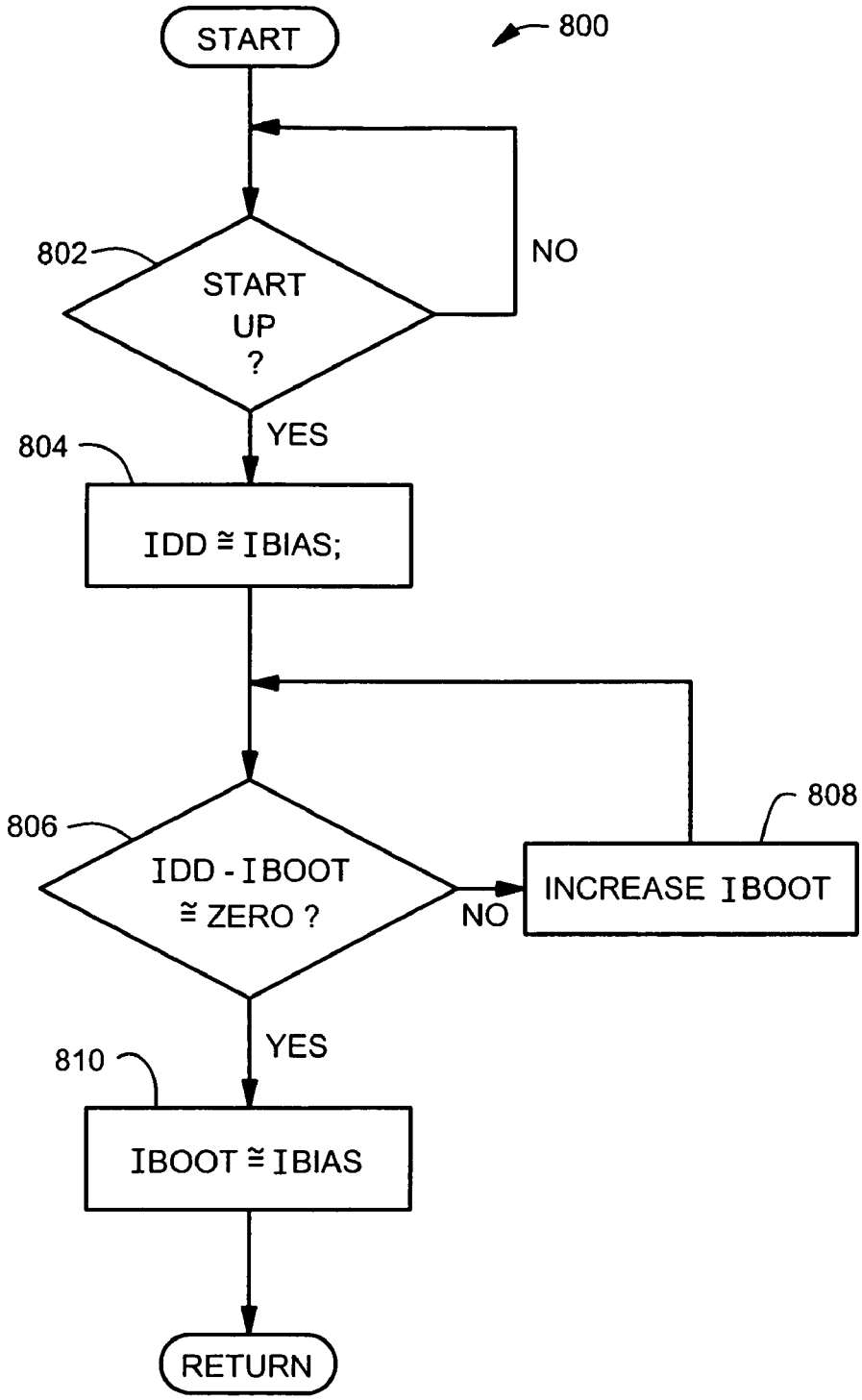
FIG. 8 illustrates a flow chart for a process that provides a bias current for a reference circuit.

FIG. 8 illustrates a flow chart for a process that provides a bias current for a reference circuit. Moving from a start block, the process flows to block 802 where a determination is made as to whether or not the reference circuit is transitioning from a substantially off mode of operation to a start up mode of operation. If false, the process loops until true.

Once the determination at decision block 802 is affirmative for startup, the process advances to block 804 where the bias current (Ibias) is substantially provided by a contribution from an independent bias current (Idd). At the initial startup of the reference circuit, Ibias is substantially equivalent to Idd and a bootstrapped bias current (Iboot) is substantially equivalent to zero. At decision block 806, a determination is made as to whether or not the independent bias current (Idd) minus the bootstrapped current (Iboot) is substantially equivalent to zero. If false, the process moves to block 808 where Ibias is generated by the mixing of an increasing Iboot and thus decreasing Idd–Iboot. Advancing from block 808, the process loops back to decision block 806 where it performs substantially the same actions as discussed above.

However, once the determination at decision block 806 is affirmative, the process can flow to block 810 where the bias current (Ibias) is substantially equivalent to the bootstrapped bias current (Iboot) and the independent bias current (Idd) is substantially equivalent to zero. Next, the process returns to performing other actions.

Although the embodiments are described for use with a reference circuit, they are not so limited. Instead, the invention discussed above may be employed with other applications that would benefit from a relatively constant and low noise biasing circuit, such as amplifiers, drivers, chargers, and the like.

The above specification, examples and data provide a description of the manufacture and use of the composition of the invention. Since many embodiments of the invention can be made without departing from the spirit and scope of the invention, the invention also resides in the claims hereinafter appended.

What is claimed is:

1. An apparatus for biasing an application, comprising:

a first circuit for substantially biasing the application at a startup state, wherein the first circuit is powered by a supply that powers the application, and wherein the first circuit further comprises a first mirror circuit for mirroring a bias current provided by the first circuit; and a second circuit for substantially biasing the application at a steady state, wherein the second circuit is powered by a bootstrapped feedback loop that is coupled to the application; and wherein a bias current that is independent of the bootstrapped feedback loop provided by the first circuit is mixed with a bootstrapped bias current provided by the second circuit during and at least after a transition from the startup state to the steady state.

2. The apparatus of claim 1, further comprising a third circuit for generating a power on and reset (POR) signal if the bootstrapped bias current is providing relatively substantial biasing for at least a portion of the application.

3. The apparatus of claim 2, further comprising a fourth circuit that employs the generated POR signal to disable the bias current provided by the first circuit if the application is operating in the steady state.

4. The apparatus of claim 2, further comprising an inverter for generating the POR signal in response to a relatively substantial change in the contribution to the biasing of the application by the bootstrapped bias current.

5. The apparatus of claim 1, further comprising a capacitor that is coupled to an inverter that generates a power on and reset (POR) signal, wherein the capacitor is charged up by the bias current provided by the first circuit during the startup state of the application, and wherein the capacitor is discharged by a mirrored portion of the bootstrapped bias current.

6. The apparatus of claim 1, wherein the first circuit further comprises a second mirror for mirroring a value of the bias current provided by the first circuit minus a value of the bootstrapped bias current.

7. The apparatus of claim 1, wherein the second circuit further comprises a third mirror circuit for mirroring the bootstrapped bias current.

8. A method for biasing an application, comprising:

biasing the application at startup with a first bias current that is powered by a supply that powers the application;

mirroring the first bias current; and employing a second bias current for biasing the application during and after a transition from a startup state to a steady state, wherein the second bias current is powered by a bootstrapped feedback loop that is coupled to the application, and wherein the first bias current is mixed with the second bias current during and at least after a transition from the startup state to the steady state.

9. The method of claim 8, further comprising generating a power on and reset (POR) signal if the bootstrapped bias current is providing substantial biasing for at least a portion of the application.

10. The method of claim 9, further comprising disabling the first bias current if the POR signal is generated.

11. The method of claim 9, further comprising generating the POR signal in response to a relatively substantial change in the contribution to the biasing of the application by the second bias current.

12. The method of claim 8, further comprising enabling a capacitor to be charged up by the first bias current during the startup state of the application, and discharging the capacitor in response to a mirrored portion of the second bias current.

13. The method of claim 8, further comprising mirroring a value of the first bias current minus a value of the second bias current.

14. The method of claim 8, further comprising mirroring the second bias current.

15. An apparatus for biasing an application, comprising:

a means for employing a first circuit to provide substantial biasing of the application at a startup state, wherein the first circuit is powered by a supply that powers the application, and wherein the first circuit further comprises a first mirror circuit for mirroring a bias current provided by the first circuit; and a means for employing a second circuit to provide substantial biasing of the application at a steady state, wherein the second circuit is powered by a bootstrapped feedback loop that is coupled to the application; and wherein a bias current provided by the first circuit is mixed with a bootstrapped bias current provided by the second circuit during and at least after a transition from the startup state to the steady state.

* * * * *